United States Patent [19]

Berthold

[11] Patent Number: 4,465,394

[45] Date of Patent: Aug. 14, 1984

[54] BALL-JOINTED BEARING ARRANGEMENT OF THE PISTON HEADS IN AN AXIAL PISTON MACHINE

[75] Inventor: Heinz Berthold, Bildechingen, Fed. Rep. of Germany

[73] Assignee: Brueninghaus Hydraulik GmbH, Fed. Rep. of Germany

[21] Appl. No.: 283,834

[22] Filed: Jul. 16, 1981

[30] Foreign Application Priority Data

Jul. 21, 1980 [DE] Fed. Rep. of Germany ..... 3027541

[51] Int. Cl.[3] ..... F01B 13/04

[52] U.S. Cl. ..... 403/122; 403/135; 403/140; 91/486; 91/507; 384/207

[58] Field of Search ..... 91/507, 499, 486; 403/122, 135, 140; 384/206, 207, 208

[56] References Cited

U.S. PATENT DOCUMENTS

| | | | |
|---|---|---|---|
| 1,276,613 | 8/1918 | Bergman | 384/209 |
| 3,611,879 | 10/1971 | Alderson | 91/507 X |
| 3,699,580 | 10/1972 | Joseph et al. | 403/135 X |
| 3,862,588 | 1/1975 | Bährle et al. | 91/486 |
| 3,911,791 | 10/1975 | Clerk | 91/499 |
| 4,382,399 | 5/1983 | Lotter | 91/486 |

FOREIGN PATENT DOCUMENTS

| | | |
|---|---|---|
| 891643 | 10/1953 | Fed. Rep. of Germany . |
| 929401 | 6/1955 | Fed. Rep. of Germany . |
| 811642 | 9/1955 | Fed. Rep. of Germany . |
| 1225051 | 5/1967 | Fed. Rep. of Germany . |

*Primary Examiner*—Thomas F. Callaghan
*Assistant Examiner*—Joseph A. Fischetti
*Attorney, Agent, or Firm*—Scully, Scott, Murphy & Presser

[57] ABSTRACT

A ball-jointed bearing arrangement of the piston heads in an axial piston machine within a drive flange wherein a bearing member formed of a material with good anti-friction properties for receiving a piston head is seated in a recess of the drive flange whereby all bearing members are covered by a covering plate which is detachably fastened to the drive flange. The bearing member is formed of a spherically indented cup of a flat material, such as sheet metal, which is inserted into the respective recess, which recesses conform in shape, pitch circle and distribution to the piston heads, however, are constructed in conformance with the thickness of the respective spherical dished cup deeper and larger in diameter, and in which the covering plate is traversed by the piston heads and is fastened on the side of the drive flange towards the piston heads.

4 Claims, 3 Drawing Figures

BALL-JOINTED BEARING ARRANGEMENT OF THE PISTON HEADS IN AN AXIAL PISTON MACHINE

BACKGROUND OF THE INVENTION

1. Field of the Invention

The present invention relates to a ball-jointed bearing arrangement of the piston heads in an axial piston machine within a drive flange wherein a bearing member formed of a material with good antifriction properties for receiving a piston head is seated in a recess of the drive flange whereby all bearing members are covered by a covering plate which is detachably fastened to the drive flange.

2. Discussion of the Prior Art

Since the piston heads of the piston rod, and the drive flange which receives these, are subjected to a high load during operation, they were originally produced from a highly wear-resistant material, such as hardened steel, preferably nitrided steel. Warping is produced as a result of the hardening of the drive flange. The spherical indentations in the drive flange which conform to the configuration of the piston head, thus required extremely precise prefinishing with respect to shape and surface finish whereby, after hardening, there was still required a lapping process in order to remove the connecting zone, to improve the surface finish and to correct the ball shape (spherical indentation). The specific load is limited due to the non-optimized antifriction of steel on steel. In the event of the failure of one of the components, there is no possibility of reworking, as a result of which the drive flange and the piston must be completely replaced.

This problem could be solved through utilization of the ball-jointed bearing support of the above mentioned type, as disclosed in German patent specification No. 1 225 051. Cylindrical recesses were accordingly provided in the drive flange the side distant from the piston head; into which these were fitted or pressed two-part bearing members with a dividing line extending transverse to the longitudinal axis of the machine and formed of a material having good antifriction properties. The fitting in of one of these parts can only be effected subsequent to the insertion of the piston head. Finally, there is effected a covering of the drive flange by means of a detachably fastened covering plate on the side of the drive flange remote from the piston head. This will facilitate that the drive flange itself can be manufactured of a lower quality material than heretofore, whereas for the bearing members or the components thereof, there can be employed a material having good antifriction properties, such as a smooth bronze alloy. Upon the failure of these components, particularly those of the bearing member, these can then be exchanged in a simple manner. However, disadvantageous in these known ball-jointed bearings, in addition to the complicated assembly thereof is also that the drive flange is extensively weakened, in effect, the dimensions must be substantially increased in order to be able to conduct along the torque which is to be transmitted. The cylindrical bores in which the bearing members must be inserted must be prefinished extremely precisely. Due to the fitting in of the bearing member a deformation can occur, as a result of which a final finishing must be effected after insertion. This type of procedure is thus encumbered with high costs.

SUMMARY OF THE INVENTION

Accordingly it is an object of the present invention to so construct a ball-jointed bearing arrangement of the above mentioned type, wherein for the capability of a simple assembly, there will take place practically no weakening of the drive flange.

The foregoing object is achieved in that the bearing member is formed of a spherically indented cup of a flat material, such as sheet metal, which is inserted into the respective recess, which recesses conform in shape, pitch circle and distribution to the piston heads, however, are constructed in conformance with the thickness of the respective spherical dished cup deeper and larger in diameter, and in which the covering plate is traversed by the piston heads and is fastened on the side of the drive flange towards the piston heads.

In the present invention, the drive flange which consists of a lower quality material, has a spherical indentation formed therein as originally, with a ball form, which is slightly larger than those of the piston head. The interspace between the piston head and the spherical indentation in the drive flange is filled by a preferably stamped spherical cup which can be somewhat hemispherically shaped. This spherical cup consists of a material having good antifriction properties, such as a smooth bronze or the like. The spherical cup can be inexpensively produced, preferably, by means of stamping from a sheet metal material with a thickness of, for example, 2 mm. The surface of the spherical indentation in the drive flange does not need to meet any special requirements with respect to roughness since the bearing function is assumed by the spherical cup. During assembly of the parts it is sufficient to merely insert the spherical cup into the spherical indentation in the drive flange, in effect, a mechanical anchoring is not required which, in particular, will render easier the exchangeability. The spherical cup is retained within the spherical indentation in the drive flange by the cover plate, and will assume the bearing forces due to its optimized antifriction properties with respect to the piston head. Advantageously there can be provided a security against rotation, which is formed by a protuberance arranged on the spherical cup, which can be inserted or pressed into a complimentary groove in the drive flange.

It is also mentioned that for ball joints, such as for the steering rods of motor vehicles, it is known to provide a spherical seat which is formed by a cup (having reference to German Pat. No. 811 642, 891 643, and 929 401), which consists of a material having good antifriction properties and which is inserted in a housing having a lower wear resistance. In all of these ball joints there are provided pressure elements which are formed by springs which press the seat against the spherical head. Furthermore, in the known ball joints there is currently taken up only a single spherical head in a bearing housing so that the problems are not present which would be encountered due to the arrangement of a plurality of piston heads within a single drive flange, such as is the case in axial piston machines, and neither with respect to the production nor with respect to the assembly. It is also mentioned that in these ball joints the antifriction-like seat is also mainly formed from two parts so that also in that case there will be encountered the referred to difficulties during assembly.

BRIEF DESCRIPTION OF THE DRAWINGS

Reference may now be had to the following description of exemplary embodiments of the invention, taken in conjunction with the accompanying drawings; in which.

DETAILED DESCRIPTION

Figure 1:
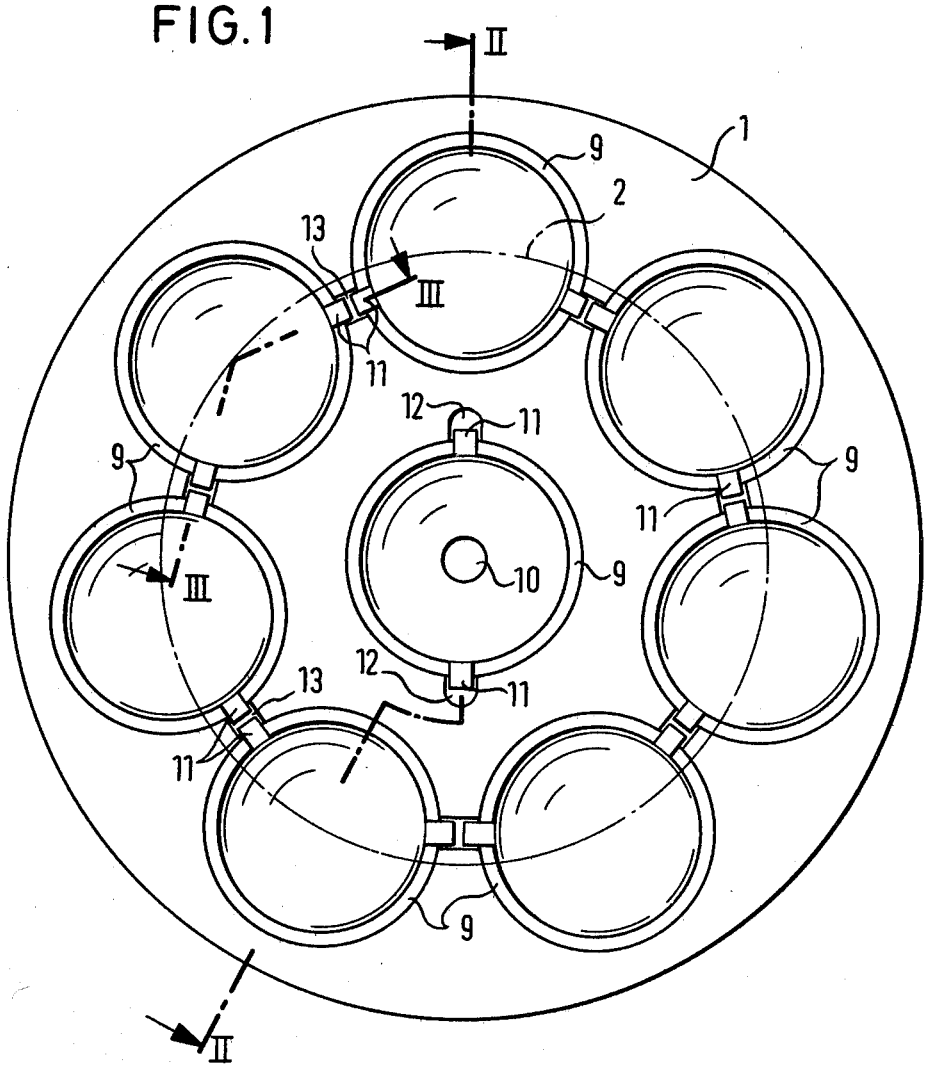
FIG. 1 illustrates a plan view of a drive flange with the cover plate shown removed and with detached piston heads.

In FIG. 1 there is illustrated the drive flange 1 of an axial piston machine which has piston heads 3 inserted therein along a path of rotation illustrated as circle 2 at a predetermined distribution. Furthermore, there is inserted a centrally located piston head 4. For fixing the piston heads 3, 4 on the drive flange, the latter has detachably fastened thereto a cover plate or disk 5 on the side towards the piston heads 3, 4. The cover plate 5 incorporates apertures 6 which provide for the passing therethrough of the piston heads 3 or 4, and which have a spherically dished contour conforming with the contour of the piston heads. This cover plate 5 can consist of a wear-resistant material. For the lubrication of the bearings there can be provided a lubricant passageway 7 at one or more of the receiving locations for the spherical piston heads 3, 4.

For the receiving of the piston heads 3, 4 in the drive flange 1 there is presently indented a spherically-shaped recess 8, in which there is inserted spherical cup 9 is inserted. This spherical cup is thin-walled and consists of highly wear-resistant material coordinated with the antifriction properties of the piston head material. In the event that there is provided a lubricant passageway 7 in the drive flange 1, then the spherical cup 9 includes a corresponding bore 10. The dimensions of the apertures 6 in the cover plate 5 are so dimensioned that the edges thereof will maintain in position the spherical cups 9 which have been inserted into the recesses 8.

The spherical cup 9 is preferably stamped out of a smooth bronze sheet metal or another flat sheet or plate material. A wall thickness or sheet metal thickness of 2 mm has been shown as being satisfactory.

Figure 3:
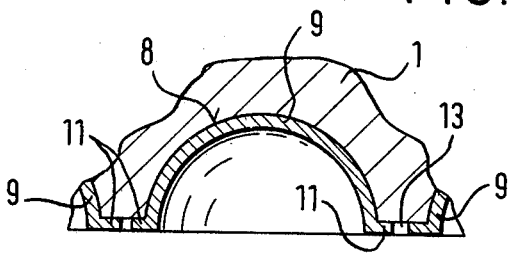
FIG. 3 is a fragmentary sectional view taken along line 3—3 in FIG. 1.
Figure 2:
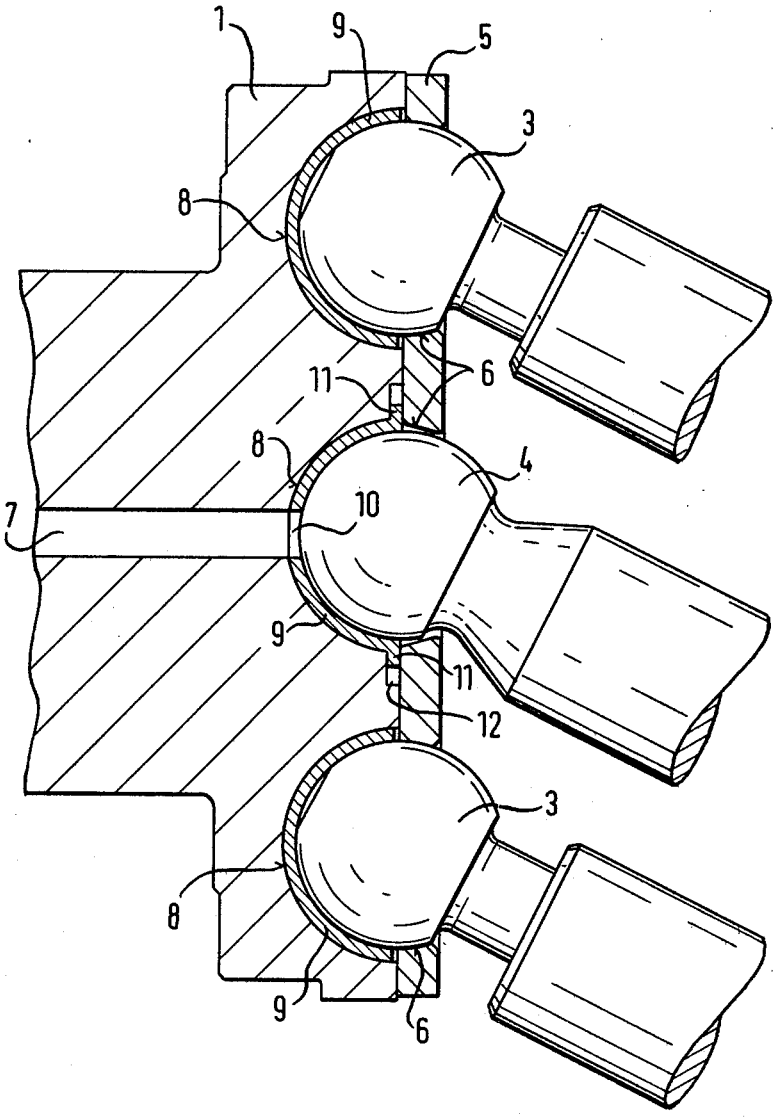
FIG. 2 is a sectional view taken along line 2—2 in FIG. 1 with applied cover plate and inserted piston heads.

Advantageously, the inserted spherical cups 9 are provided with a security against rotation. This security, in the illustrated embodiments, is formed by two protuberances 11 provided at each spherical cup 9, which are inserted or pressed into a corresponding groove 12 formed in the drive flange 1. As illustrated in FIG. 3 the protuberances 11 of the centrally located spherical cup 9 are positioned diametrically opposite each other, for convience of illustration. This i11ustration is a diagramatic flattening of chords III, III illustrated in FIG. 1. In FIG. 1, the protuberances are located for the spherical cups 9 along chords III, III of the circle 2 in such a manner that, for the receiving of protuberances 11 in the drive flange 1, they will fit into a groove 13 extending from point to point along this circle. For the simplification of the production of the spherical cups 9 there can, naturally, also be provided spherical cup 9 for the centrally located recess 8 in the drive flange 1 whereby the present grooves must be provided at a corresponding location. The equivalent is also applicable in the utilization of the spherical cups 9 with diametrically oppositely located protuberances for the recesses 8 along the circle 2. Obviously it can also be sufficient to merely provide a single protuberance and, naturally, there can also be provided more than two protuberances.

An important advantage of the ball-jointed bearing arrangement lies in that the drive flange 1 can be produced of a comparably lower grade wear-resistant material whereby, during the manufacture of the recesses 8 practically no weakening of the drive flange 1 will occur, which signifies that a drive flange can be produced having dimensions which correspond to those which are applicable to drive flanges which are fully produced of a wear-resistant material. Furthermore, the wear-resistant spherical cups 9 with good antifriction properties can be produced inexpensively and, upon failure, can be exchanged at low cost since there is merely required an insertion of the spherical cup 9 into the corresponding recess 8, and since the surface roughness of the recess 8 need not meet any special requirements. The production of the spherical cups 9 from sheet metal material allows for elimination of the heretofore required final finishing. In summation, through the intermediary of the invention it is possible to achieve an inexpensive and thus economically feasible ball-jointed bearing support for the piston heads within a drive flange in an axial piston machine.

What is claimed is:

1. A bearing arrangement for a drive flange in an axial piston machine, said arrangement comprising:
   (a) a plurality of pistons and piston heads mounted in an axial piston machine, said plurality of pistons defining a first rotational axis, a rotational path about said axis, and a plurality of reciprocating axes which intersect said rotational path;
   (b) a drive flange for an axial piston machine, said flange having a plurality of recesses formed therein, with a single recess for each piston head;
   (c) a plurality of bearing cups, with a single bearing cup interposed between each of said piston heads at its cooperating recess, each of said bearing cups being loosely fitted into and supported by said drive flange while providing a wear resistant surface for its cooperating piston heads;
   (d) means for securing said loosely fitting bearing cups in said recesses and counteracting rotational forces imparted to said cups by said piston, said means including a first and second opposed protuberance for each bearing, with said protuberances being aligned along a pair of cords which intersect the rotational path defined by the rotation of said piston heads, said means also including a plurality of grooves formed in said drive flange for receiving each of said protuberances;

2. A bearing arrangement as claimed in claim 1, wherein said bearing cup is generally hemispherically-shaped.

3. A bearing arrangement as claimed in claim 1, wherein said bearing cup is stamped out of flat material.

4. A bearing arrangement as claimed in claim 3 wherein said bearing cups are approximately 2 mm in thickness.

* * * * *